United States Patent [19]

Mier et al.

[11] Patent Number: 5,049,000

[45] Date of Patent: Sep. 17, 1991

[54] CONTINUOUS FLOW INTERSECTION

[76] Inventors: Francisco D. Mier, 5425-3 Lake Murray Blvd., La Mesa, Calif. 92041; Belisario H. Romo, Guadalajara 93, Col. Roma, Mexico City, Mexico

[21] Appl. No.: 137,372

[22] Filed: Dec. 23, 1987

[51] Int. Cl.[5] ..... E01C 1/04

[52] U.S. Cl. ..... 404/1; 14/1

[58] Field of Search ..... 404/1; 14/1

[56] References Cited

U.S. PATENT DOCUMENTS

| | | | |
|---|---|---|---|
| 2,946,267 | 7/1960 | Cedeno | 404/1 |
| 2,949,067 | 8/1960 | Cedeno | 404/1 |
| 3,107,590 | 10/1963 | Cedeno | 404/1 |
| 3,386,351 | 6/1968 | Hara | 404/1 |
| 3,394,638 | 7/1968 | Burrell | 404/1 |
| 4,592,673 | 6/1986 | Lee | 404/1 |
| 4,630,961 | 12/1986 | Hellwig | 404/1 |
| 4,861,184 | 8/1989 | Mier | 404/1 |

FOREIGN PATENT DOCUMENTS

| | | | |
|---|---|---|---|
| 932189 | 8/1973 | Canada | 404/1 |

*Primary Examiner*—Bruce Kisliuk

[57] ABSTRACT

A continuous flow intersection for accommodating traffic from a plurality of road surfaces includes a first road surface for traffic traveling in a first direction. A second road surface is provided for traffic traveling in a direction opposite to the first direction. A third road surface is provided for traffic traveling in a direction intersecting the first and second road surfaces. A fourth road surface is provided for traffic traveling in a direction opposite to the traffic traveling on the third road surface. The first and second road surfaces intersect the third and fourth road surfaces and are disposed at a first elevation distinct relative to the third and fourth road surfaces in an area adjacent to the intersection. At least a first road surface left turn lane is disposed along the first road surface at a point displaced a predetermined distance from the intersection. The first road surface left turn lane diverts traffic from the first road surface to cross the second road surface and to continue traveling in a direction opposite to the second road surface in an area displaced laterally from the first road surface. The first road surface left turn lane traverses the intersection at the first elevation distinct from the third and fourth road surfaces and enables traffic to turn left without stopping and to merge from the right with traffic traveling along the fourth road surface.

24 Claims, 11 Drawing Sheets

CONTINUOUS FLOW INTERSECTION

BACKGROUND OF THE INVENTION

1. Field of the Invention

The present invention relates to a continuous flow intersection and more particularly to a two grade level street crossing intersection enabling continuous traffic flow. The present invention permits traffic to turn from a left lane and merge from a right lane with intersecting traffic.

2. Description of Related Art

Vehicular traffic on many city streets has increased to the point that a conventional single level interchange cannot effectively handle the volume. Multi-level street crossing interchanges which permit continuous traffic flow are common on interstate highways, but they are impractical for use in a crowded city environment. They usually include large radius cloverleaf turns covering a large land area, and typically also include traffic lanes stacked up on three or more grade levels. The cost of land acquisition to build such an interchange for a busy city street intersection would be prohibitive. For æsthetic purposes no more than two grade levels should be present. Preferably, one of the grade levels should be below ground level. A preferred interchange should also enable optional U-turns and a continuous flow of pedestrian traffic with minimal exposure to vehicular traffic.

An example of a typical large interstate intersection is illustrated in U.S. Pat. No. 3,107,509, issued to A. O. Cedeno et al on Oct. 22, 1963. This intersection requires use of extensive adjoining property to accommodate its wide turning lanes.

U.S. Pat. No. 2,946,267, issued to A. O. Cedeno et al on Jul. 26, 1960, is illustrative of a traffic intersection which can be used for city streets. However, no provision is made for U-turns, and making right turns is unnatural because they must be initiated from the left side of the streets. Further, more than two grade levels are required, and all through lanes must change in grade level at the street intersection.

U.S. Pat. No. 2,949,067, issued to A. O. Cedeno et al on Aug. 16, 1960, discloses a traffic intersection similar to that of U.S. Pat. No. 2,946,267, but providing for left turns from the left side of the streets. However, it lacks any provision for U-turn traffic. In addition, thru traffic in the intersection is reversed for the normal flow of traffic.

SUMMARY OF THE INVENTION

According to the present invention, a continuous flow intersection is provided comprising first and second streets having intersecting through lanes at two grade levels. One level is at ground elevation while another level is above or below ground.

The intersection is characterized by right turn lanes which are all located at a grade level. Left turn lanes may originate from the left or right side of each street and cross over to be eventually on the left side of advancing traffic prior to reaching the intersection. Each left turn lane then curves through the intersection to enable traffic to merge from a right lane with intersecting traffic.

The interchange is characterized by optional U-turn lanes located immediately adjacent the street intersection, and at one level so that some motorists can easily reverse directions when they desire.

The foregoing arrangement allows continuous traffic flow with minimum addition land being required as compared to the land required for a conventional single level city street intersection. The two level structure is aesthetically acceptable and can be made even more so by locating the second level below ground. Pedestrian traffic is possible with a minimum number of underpasses or overpasses.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
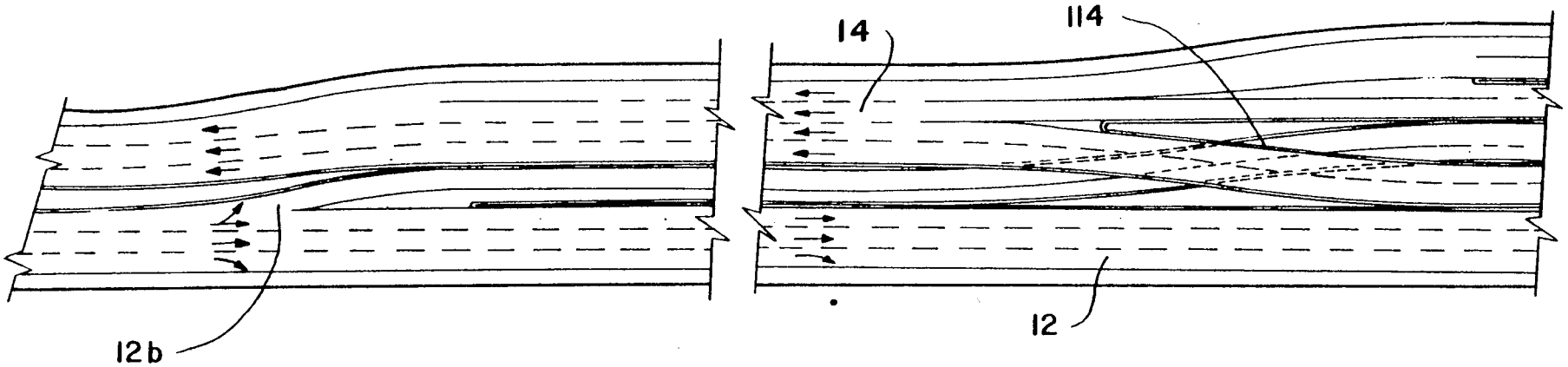
FIG. 1 is a top plan view of a western section of a street which is connected with a central crossing interchange.

FIGS. 1-5 illustrate sections of streets leading to an intersection for a continuous flow interchange 10. A plurality of road surfaces approach and depart from the continuous flow intersection 10. For the purposes of explaining the present invention, the plurality of road surfaces will be referred to as a first road surface 12, a second road surface 14, a third road surface 16 and a fourth road surface 18. For the purpose of only describing the relationship of the roads relative to each other, the following description does refer to the directions of east, west, north and south. However, referring to specific directions is only for the purpose of explanation and does not limit the particular orientation of the various road surfaces relative to the earth's magnetic north.

The first road surface 12 advances in an easterly direction. The right lane 12*a* of the road surface 12 includes a turning section 22 for permitting a right-hand turn. The turning section 22 is an elevated section of the highway which eventually merges downwardly to permit traffic traveling along the road surface 12 to complete a right-hand turn and merge with traffic in the third lane 16. As illustrated in FIG. 1, if an individual wishes to commence a left-hand turn, the section of the road surface 12*b* diverts the traffic away from the primary road surface 12. Thus, an individual wishing to commence a left-hand turn from the road surface 12 is disposed on the left-hand side of the road surface 12 prior to reaching the continuous flow interchange 10. The section 12*b* of the road is a depressed portion which travels beneath the bridge 114 and thereafter is elevated to reach the turning radius 22*b*. The turning radius 22*b* permits a left-hand turn of the traffic originally traveling along the road surface 12. The section of the traffic which is diverted onto the road surface 12*b* actually crosses over to be on the left side of the oncoming traffic traveling westerly along the second road surface 14.

After traffic which wishes to commence a left-hand turn from the road surface 12 actually traverses along the radius 22*b*, the traffic merges on the right-hand side together with the traffic traveling along the fourth road surface 18.

As a vehicle travels along the curved section 22*b*, the vehicle reaches a U-turn section 22*c*. The U-turn section 22*c* permits a vehicle to change its direction 180° and travel along a right-hand turn section 26 of the third road surface 16. Thereafter, the vehicle will merge onto the second road surface 14.

Figure 2:
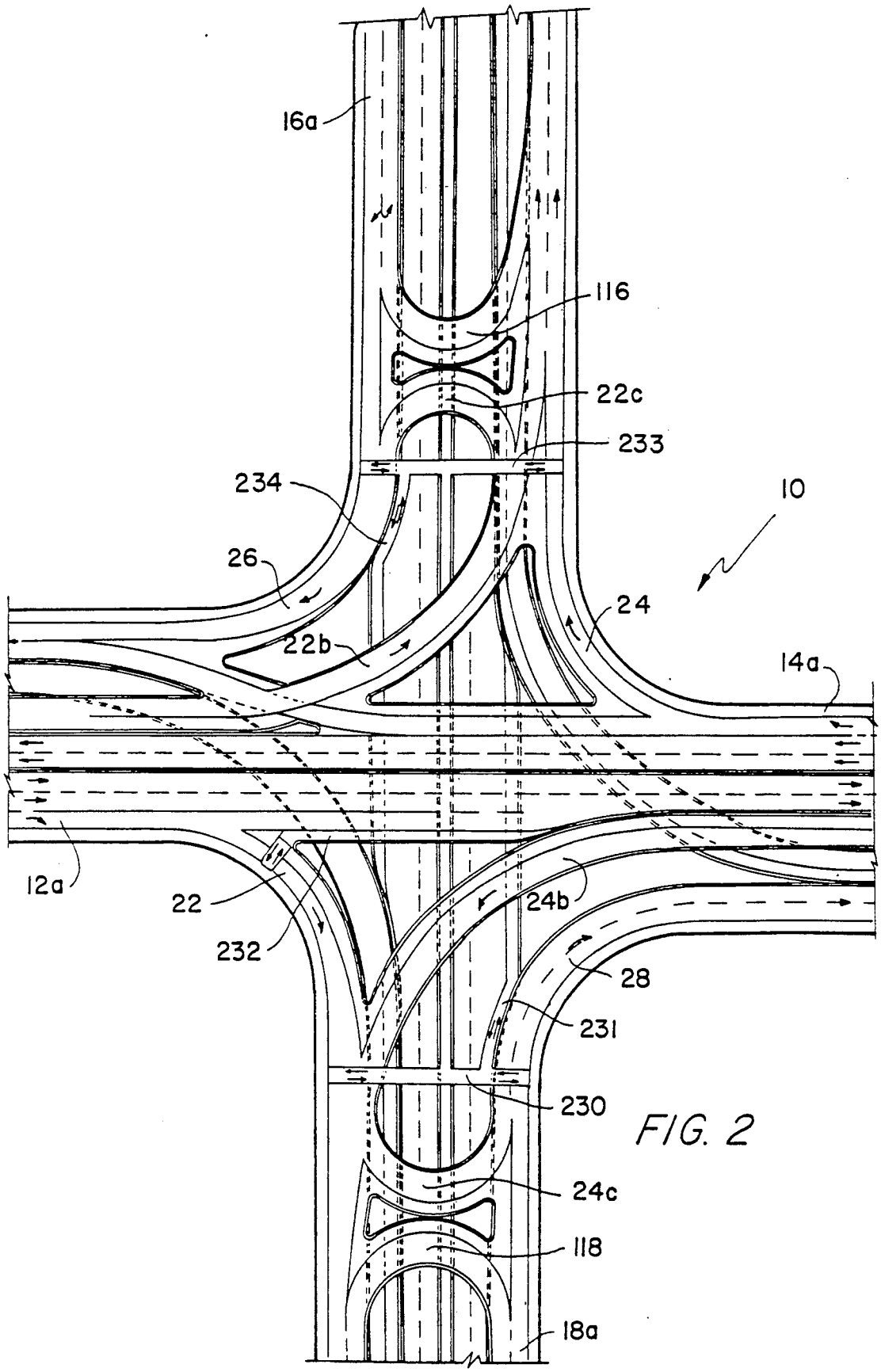
FIG. 2 is a top plan view of a central section of a street crossing interchange according to the present invention.
Figure 3:
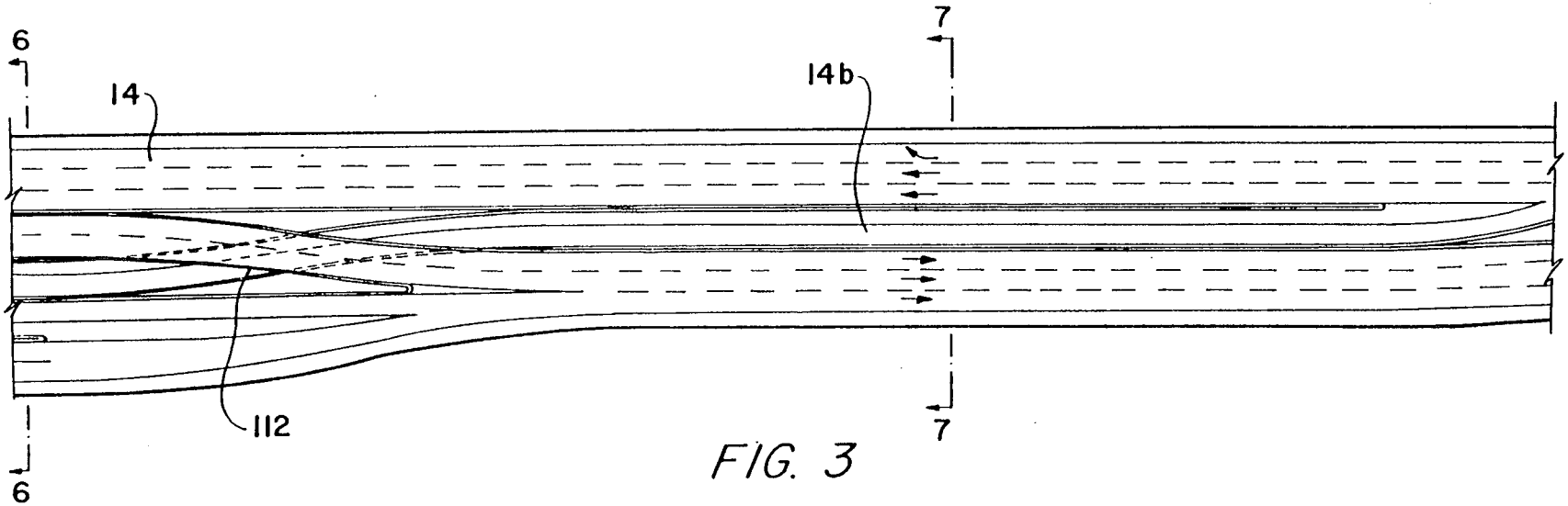
FIG. 3 is a top plan view of an eastern section of a street which is connected with a central crossing interchange.
Figure 4:
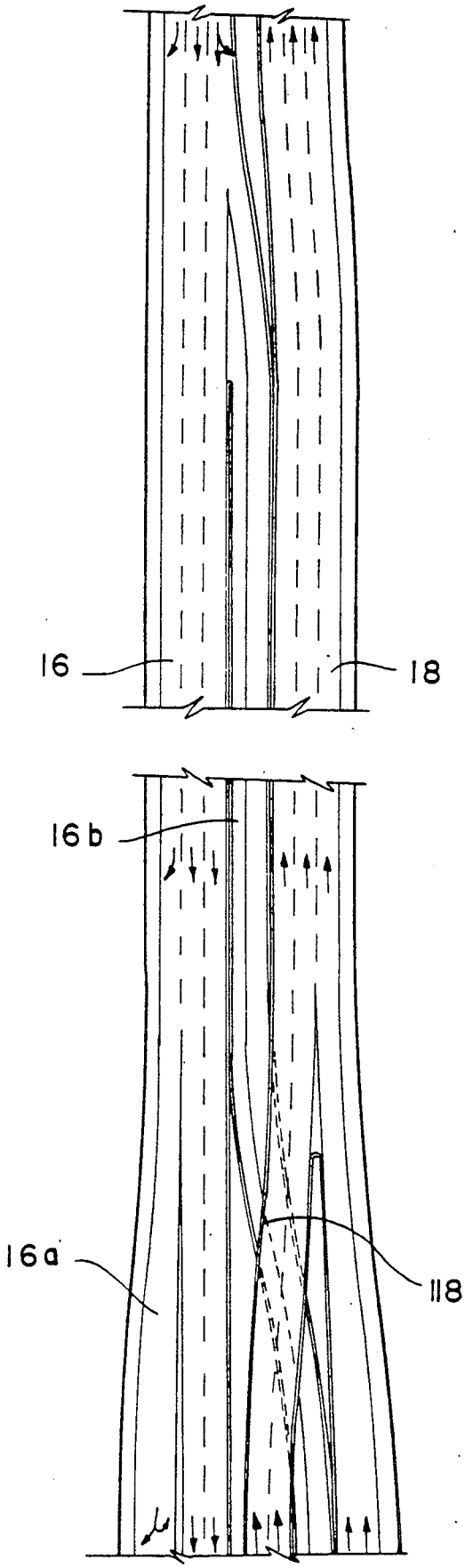
FIG. 4 is a top plan view of a northern section of a street which is connected with a central crossing interchange.
Figure 5:
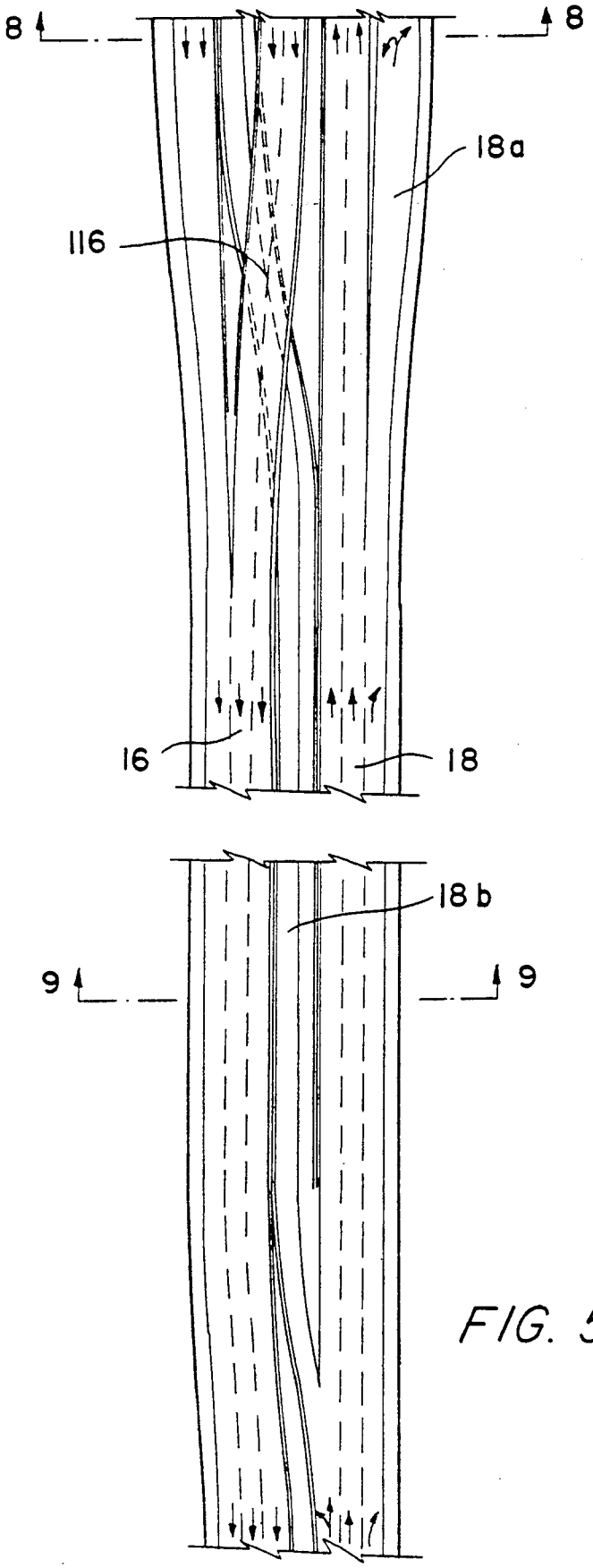
FIG. 5 is a top plan view of a southern section of a street which is connected with a central crossing interchange.
Figure 6:
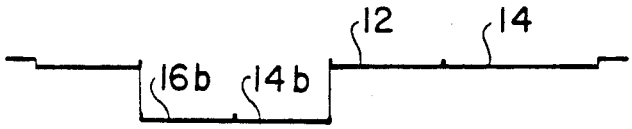
FIG. 6 is a cross-sectional view taken along line 6—6 of FIG. 3.
Figure 7:
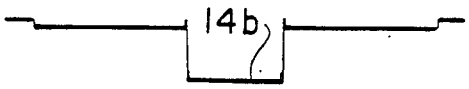
FIG. 7 is a cross-sectional view taken along line 7—7 of FIG. 3.

Similar to the flow of traffic along the first road surface 12, traffic traveling along the second road surface 14 in a westerly direction will approach similar left and right-hand exit lanes. As illustrated in FIG. 2, a right-hand turn lane 14*a* and a right-hand turn section 24 enable vehicles traveling along the second road surface 14 to complete a right-hand turn. Thereafter, the vehicles merge together with traffic traveling along the curved section 22*b*. After traveling along the merging lane, traffic wishing to complete a right-hand turn will merge, as illustrated in FIG. 4, with traffic traveling along the fourth road surface 18. A left-hand turn lane 14*b* is illustrated in FIGS. 3, 6 and 7. The left-hand turn lane 14*b* departs from the second road surface 14 at a point displaced from the continuous flow interchange 10. The left-hand turn lane 14*b* is depressed relative to the ground surface and travels beneath a bridge 112. After traveling beneath the bridge 112, the left-hand lane 14*b* is disposed on the left-hand side of the oncoming traffic traveling along the first road surface 12. Thereafter, the traffic will approach the turning radius 24*b*. The turning radius 24*b* is an elevated section which is on the same level with the turning radius 22 which represents the right-hand turning lane of the first road surface 12.

Vehicles traveling along the turning radius 24*b* will merge together with vehicles completing a right-hand turn along the turning radius 22. Finally, the vehicles will merge on the right-hand side of the third road surface 16.

A U-turn section 24*c* is provided adjacent to the turning radius 24*b*. Motorists who wish to make a U-turn, would travel along the left-hand lane 14*b* and complete the turn at the turning radius 24*b*. Thereafter, the motorist would travel along the U-turn section 24*c* and merge with traffic to permit the motorist to enter onto the first road surface 12.

As illustrated in FIG. 4, vehicles traveling along the third road surface 16 would approach a right-hand turn lane 16*a*. A turning radius 26 enables vehicles traveling along the right-hand turn lane 16*a* to complete a right-hand turn and thereafter, merge with vehicles traveling along the second road surface 14. As a vehicle in the right turn lane 16*a* approaches a U-shaped turn 116, a motorist would have an option to complete a U-turn and thereafter, merge together with traffic coming from the right-hand turn radius 24 and the left-hand turn radius 22*b*. Finally, the traffic wishing to complete a U-turn by utilizing the U-turn 116 would merge together with the traffic traveling along the fourth road surface 18.

A left turn lane 16*b* is provided at a position displaced relative to the continuous flow interchange 10. The traffic traveling along the left turn lane 16*b* is depressed relative to the road surface 16. The traffic travels beneath a bridge 118 to actually travel to the left of traffic approaching along the fourth road surface 18. Thereafter, traffic traveling along the left turn lane 16*b* travels beneath the first road surface 12 and the second road surface 14 and beneath the left turn lane 14*b*. As illustrated in FIG. 6, the traffic traveling along the left turn lane 16*b* is at the same elevation along line 6—6 as the left turn lane 14*b*. The traffic eventually merges together with traffic making a right-hand turn from the fourth road surface 18. Finally, traffic commencing along the left turn lane 16*b* merges on the right-hand side of traffic traveling easterly along the first road surface 12.

Traffic traveling along the fourth road surface 18 may commence a right-hand turn by traveling along the right-hand turn lane 18*a*. The traffic will reach the turning radius 28 at an elevated position relative to the fourth road surface 18. Thereafter, the traffic will travel along the road surface and merge with traffic from the left-hand turn lane 16*b*. Finally, the traffic will merge with traffic traveling along the first road surface 12. As traffic travels along the right-hand turn lane 18*a*, a motorist does have an option to make a U-turn. A U-turn section 118 is provided to permit an individual to commence a U-turn. Thereafter, the traffic completing a U-turn will merge with traffic from the left-hand turn lane 14*b* and the right-hand turn lane 12*a*. Finally the traffic will merge with traffic on the third road surface 16.

Figure 9:
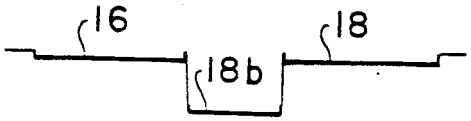
FIG. 9 is a cross-sectional view taken along line 9—9 of FIG. 5.

A left-hand turn lane 18*b* is provided at a point displaced relative to the continuous flow interchange 10. The traffic travels downwardly in a depressed area relative to the fourth road surface 18. As illustrated in FIG. 9, the left-hand turn lane 18*b* is at a lower elevation relative to the third road surface 16 and the fourth road surface 18.

Motorists traveling along the left-hand turn lane 18 will travel beneath a bridge 116. Thereafter, the traffic in the left turn lane 18*b* is disposed to the left of oncoming traffic traveling along the third road surface 16. The traffic in the left turn lane 18*b* travels beneath the first road surface 12 and the second road surface 14. Thereafter, the traffic travels upwardly to merge with traffic making a right-hand turn along the radius 26. Finally, the traffic will merge with traffic traveling along the second road surface 14.

Figure 8:
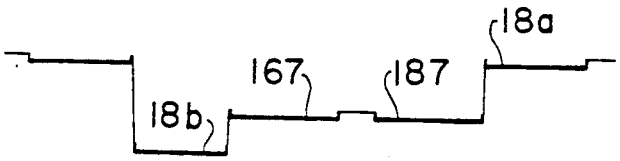
FIG. 8 is a cross-sectional view taken along line 8—8 of FIG. 5.

As illustrated in FIG. 8, three distinct elevations of road surfaces are provided as taken along line 8—8. The right-hand turn lane 18*a* is at a distinct elevation relative to the third road surface 16 and the fourth road surface 18. Similarly, the left turn lane 18*b* is at a distinct elevation relative to the right turn lane 18*a*, the third road surface 16 and the fourth road surface 18. The right turn lane 22 is at the same relative as the left turn lane 18*a*.

A pedestrian walkway 230 is provided to permit pedestrians to travel over the third road surface 16 and the fourth road surface 18. In addition, a pedestrian walkway 231 is provided to permit individuals to walk parallel with the fourth road surface 18. Similarly, a pedestrian walkway 232 is provided to permit individuals to have access to a portion of the first road surface 12. An additional pedestrian walkway 233 is provided to permit individuals to travel over the third road surface 16 and the fourth road surface 18 to the north of the continuous flow interchange 10. In addition, the pedestrian walkway 234 is provided to permit individuals to travel beneath the first road surface 12 and the second road surface 14. Similarly, the pedestrian walkway 231 permits individuals to travel beneath the first road surface 12 and the second road surface 14 in a northerly direction relative to the continuous flow interchange 10.

Figure 10:
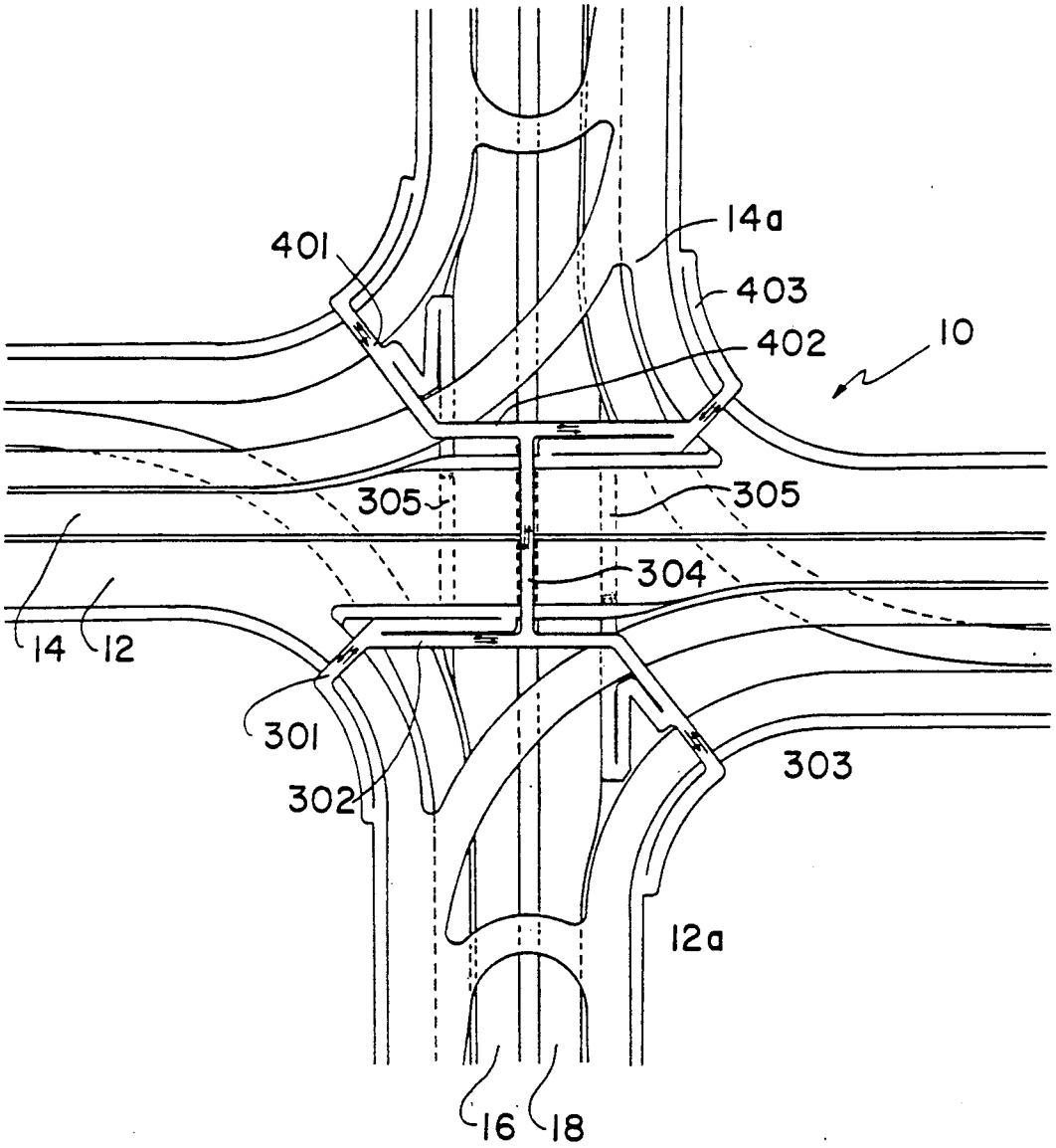
FIG. 10 is a top plan view of an embodiment of the present invention which is similar to the embodiment illustrated in FIG. 2 and further includes pedestrian crosswalks.

FIG. 10 illustrates a schematic view of additional pedestrian walkways. A first pedestrian walkway 301 permits individuals to travel to a point adjacent to the first road surface 12. A second pedestrian walkway 302 enables individuals to travel over the third road surface 16 and the fourth road surface 18. A third pedestrian walkway 303 permits individuals to travel to the easterly direction to be adjacent to the right turn lane 18*a*. In addition, a fourth pedestrian walkway 304 permits individuals to travel over the top of the first road surface 12 and the second road surface 14. Similarly, pedestrian walkways 305 and 306 permit individuals to travel beneath the first road surface 12 and the second road surface 14.

The pedestrian walkways are repeated on the northern side of the continuous flow interchange 10. A pedestrian walkway 401 enables pedestrians to travel to a point adjacent to the second road surface 14. Another pedestrian walkway 402 permits individuals to travel along a predetermined length of the second road surface 14. A pedestrian walkway 403 enables individuals to travel adjacent to the right turning lane 14*a* of the second road surface 14.

Figure 11:
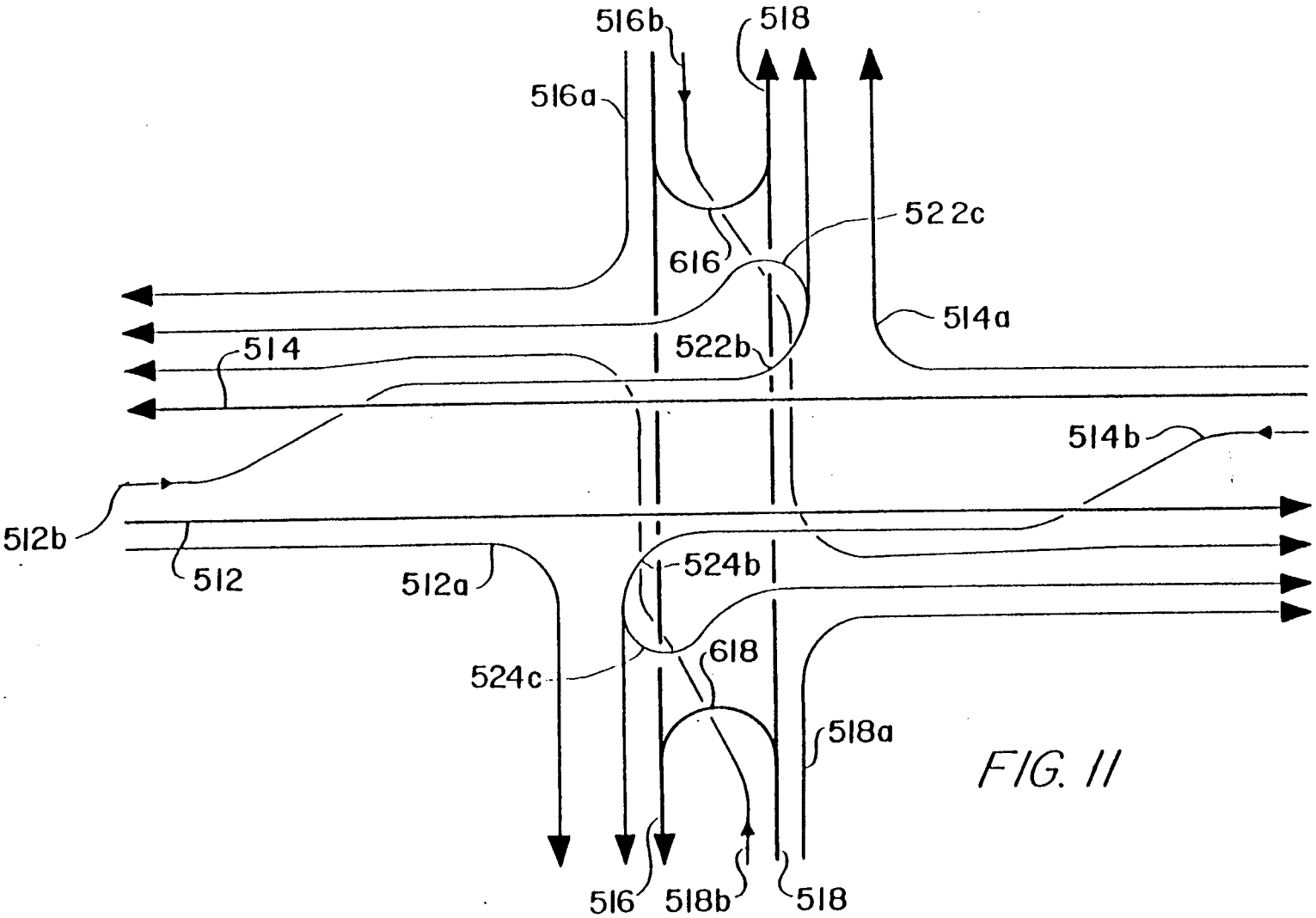
FIG. 11 is a schematic plan view of a street crossing intersection with four left turn lanes and four U-turns.

FIG. 11 illustrates a schematic view of various directions of travel for vehicles. Vehicles traveling along a first road surface 512 can exit on a left-hand turn lane 512*b*. The left-hand turn lane 512*b* is disposed on the left-hand side of the first road surface 512. Thereafter, the left-hand turn lane 512*b* travels beneath a second road surface 514. Finally, the left-hand turn lane approaches a left-hand turning radius 552*b*. Thereafter, the traffic can merge together with traffic traveling along a fourth road surface 518. Motorists traveling along the turning radius 522*b* have an option to complete a U-turn. The U-turn 552*c* enables the motorist to merge with traffic traveling along the second road surface 514. In addition, a right turning lane 512*a* is provided to permit a motorist to merge with traffic traveling along a third road surface 516.

Similarly, traffic traveling along the second road surface 514 may exit at a right turn lane 514*a*. In this manner, motorists may merge with traffic traveling along the fourth road surface 518. In addition, a left turn lane 514*b* is provided to permit motorists traveling along the second road surface 514 to complete a left-hand turn. The motorists would travel beneath the first road surface 512 and be disposed on the left-hand side of oncoming traffic positioned on the first road surface 512 for a predetermined length of roadway. Thereafter, the left-hand turn lane 514*b* would be elevated to travel above the fourth road surface 518 and the third road surface 516. Thereafter, traffic traveling along the left-hand turn lane 514*b* will merge with traffic on the third road surface 516.

Traffic traveling along the left turn lane 514*b* can complete a U-turn. As the traffic reaches a left turn radius 524*b*, the traffic can commence a left-hand turn at the left-hand turn lane 524*c*. Thereafter, the traffic will merge with traffic traveling along the first road surface 512.

Similarly, traffic traveling along the third road surface 516 can complete a right-hand turn by traveling on the right-hand turn lane 516*a*. The traffic will merge with traffic traveling along the second road surface 514. In addition, a left turn lane 514*b* is provided. Individuals traveling along the left turn lane 516*b* will travel beneath the fourth road surface 518 and be disposed on the left-hand side of traffic approaching along the fourth road surface 518 for a predetermined length of time. Thereafter, traffic in the left turn lane 516*b* will merge with traffic traveling along the first road surface 512.

Traffic traveling along the fourth road surface 518 can complete a right-hand turn by exiting on the right-hand turn lane 518*a*. Thereafter, the traffic in the right turn lane 518*a* will merge with traffic on the first road surface 512. In addition, traffic traveling along the fourth road surface 518 may exit on the left turn lane 518*b*. Thereafter, the traffic will travel beneath the oncoming traffic traveling along the third road surface 516. The traffic in the left turn lane 518*b* will travel below the first road surface 512 and the second road surface 514. Thereafter, the traffic will merge with traffic traveling along the second road surface 514.

Individuals traveling along the third road surface 516 and the fourth road surface 518 may commence a U-turn. More specifically, as an individual travels along the third road surface 516, the individual approaches the U-turn lane 616U. Thereafter, an individual may commence a U-turn and merge with traffic traveling along the fourth road surface 518. Similarly, traffic traveling along the fourth road surface 518 may commence a U-turn at the U-turn 618U. Thereafter, the traffic traveling along the U-turn 618U will merge with traffic traveling along the third road surface 516.

Figure 12:
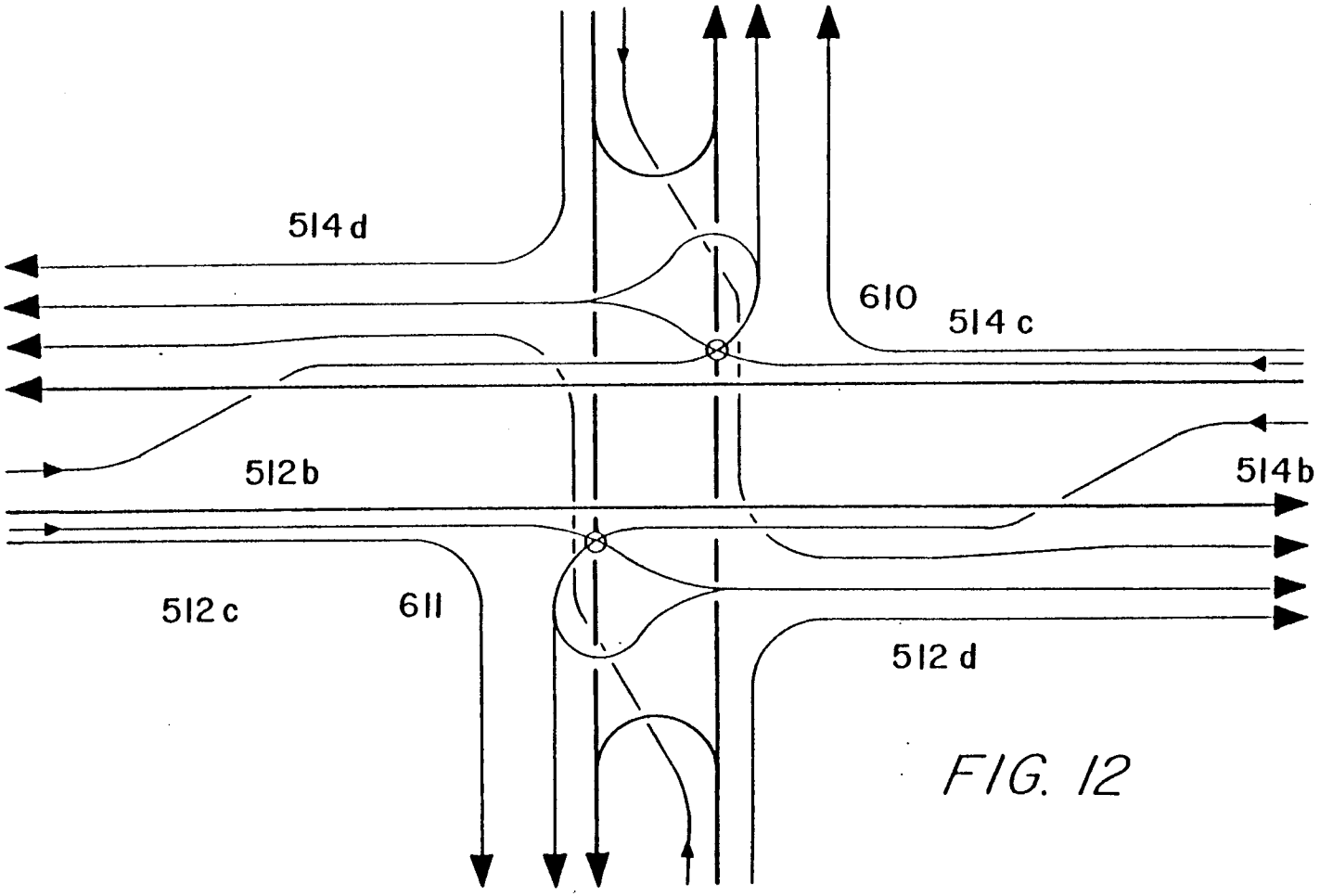
FIG. 12 is a schematic plan view of a street crossing intersection with four left turn lanes, four U-turns and two stop lights.

FIG. 12 is substantially similar to the road surface as illustrated in FIG. 11. Both FIGS. 11 and 12 illustrate left-hand turns which commence from the left lane of any of the road surfaces and permit motorists to travel onto an intersecting road surface on the right-hand side. The reference numerals in FIG. 12 are substantially similar to the reference numerals in FIG. 11. However, a traffic light 610 is provided to enable individuals traveling along a local road surface 514*c* to stop to permit traffic traveling along the left turn lane 512*b* to complete a left turn. Thereafter, traffic traveling along the road surface 514*c* will continue onto the road surface 514*d*. In this manner, traffic on the road surface 514*d* may frequent shops disposed in the northwestern quadrant of the schematic drawing.

Similarly, a traffic light 611 is provided to control the traffic traveling along a road surface 512*c*. Traffic in the left turn lane 514*b* can be controlled relative to the traffic in the local roadway 512*c*. Traffic traveling along the local roadway 512*c* can continue onto the roadway 512*d*. In this manner, traffic on the roadway 512*d* can frequent shops in the southeastern quadrant of the schematic drawing.

Figure 13:
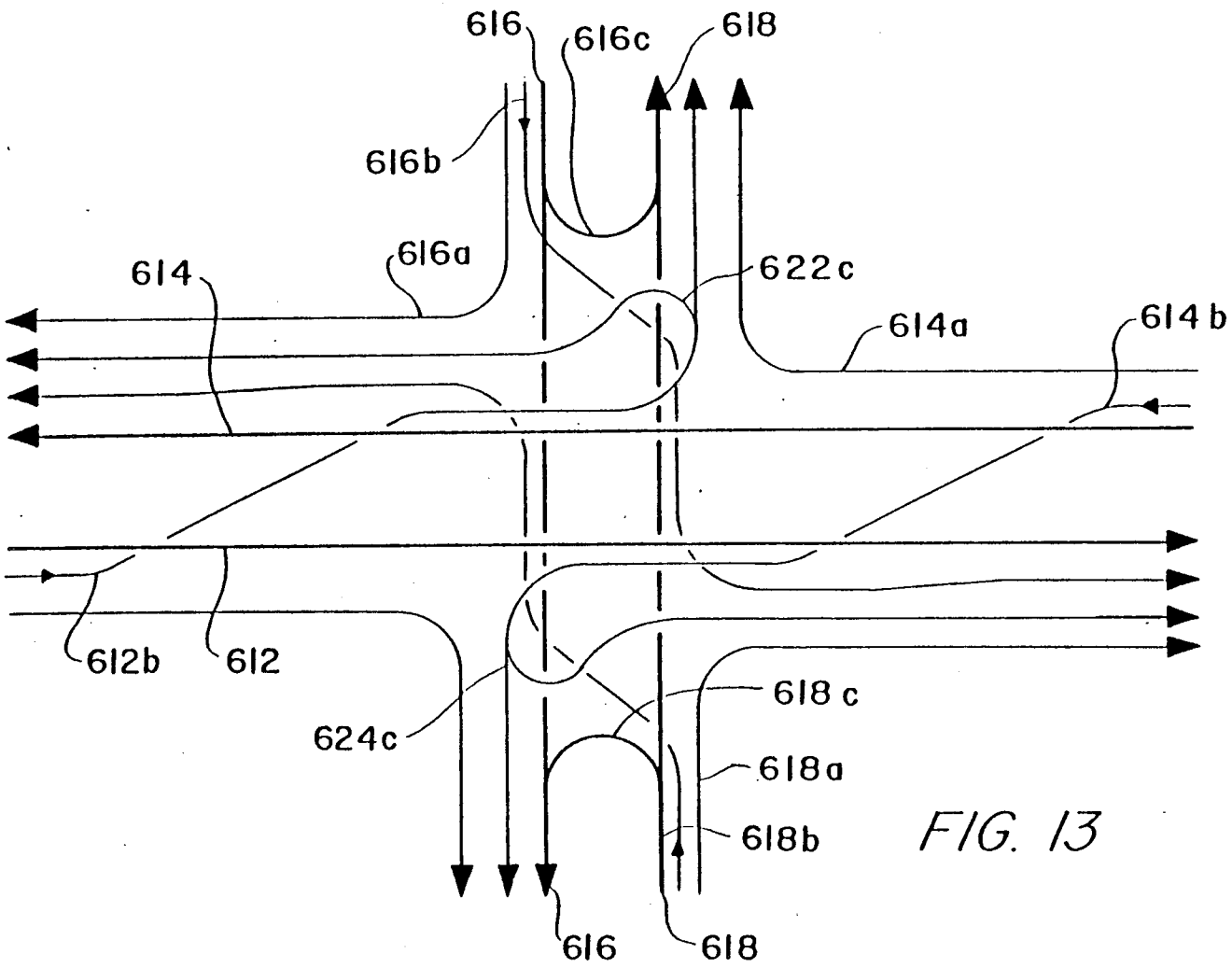
FIG. 13 is a schematic plan view of a street crossing intersection with four outside left turn lanes and four U-turns.
Figure 14:
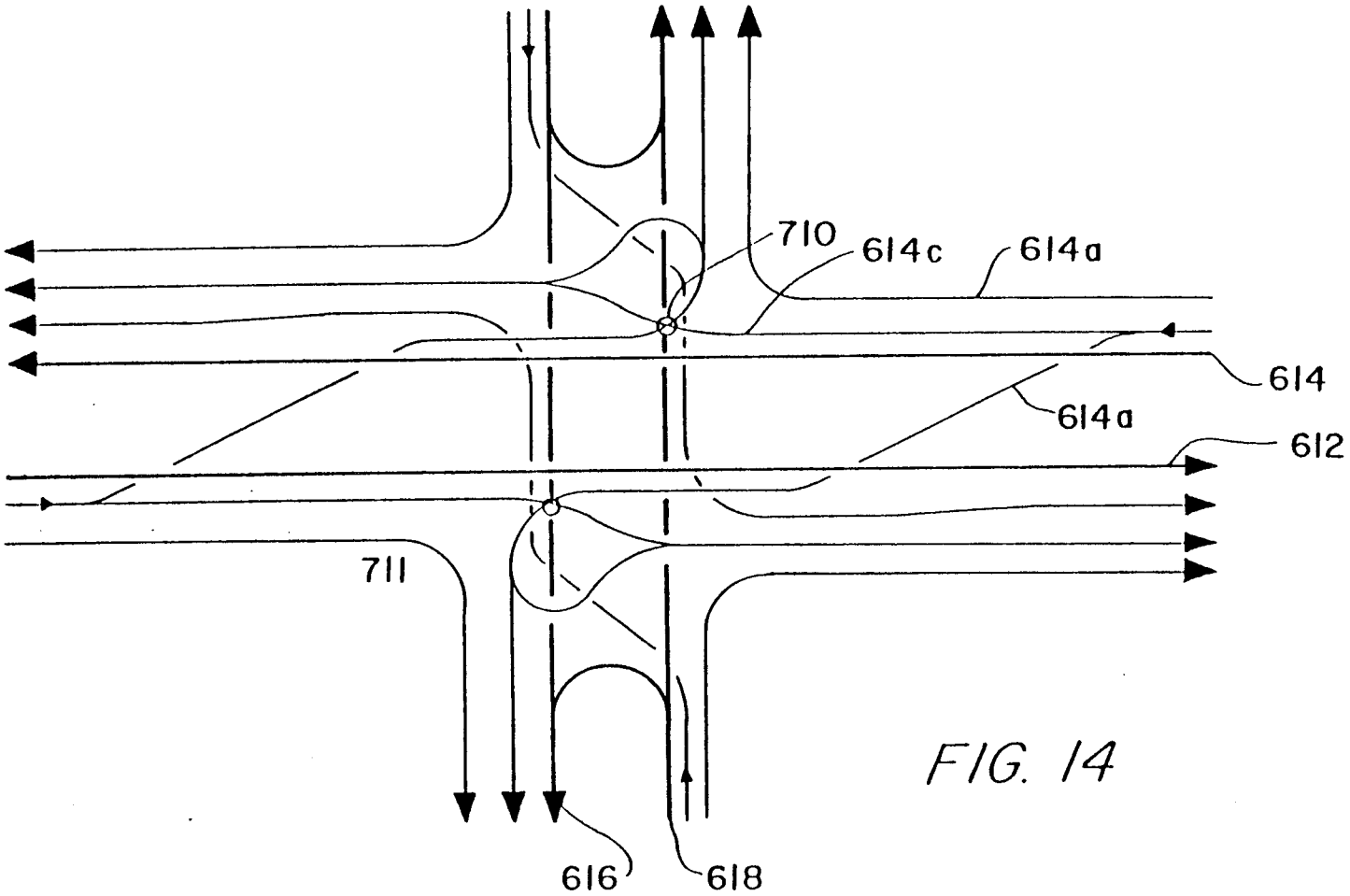
FIG. 14 is a schematic plan view of a street crossing intersection with four outside left turn lanes, four U-turns and two stop lights.

FIGS. 13 and 14 disclose another embodiment of the present invention. A left turn lane 612*b* is provided with initiates on the right side of the roadway 612. Thereafter, the left turn lane 612*b* travels beneath the first road surface 612 and the second road surface 614 to permit an individual to make a right turn and merge with traffic on a fourth road surface 618. As previously mentioned, an individual would be permitted to make a U-turn by traveling along the road surface 622*c*. Thereafter, the individual making a U-turn would merge together with traffic on the second road surface 614.

Similarly, traffic traveling along the second road surface 614 would be enabled to complete a right-hand turn by traveling along the right-hand turn lane 614*a*. In addition, traffic wishing to complete a left-hand turn would exit on the left-hand turn lane 614*b*. The left-hand turn lane 614*b* is disposed on the right side of second road surface 614. The left turn lane 614*b* travels beneath the second road surface 614 and the first road surface 612. Thereafter, a motorist may merge with traffic traveling along the third road surface 616. In addition, a motorist may complete a U-turn by traveling along the U-turn section 624*c*. Thereafter, the traffic will merge with traffic on the first road surface 612.

Traffic traveling along the third road surface 616 can complete a right-hand turn by exiting onto the right-hand turn lane 616*a*. Thereafter, the traffic will merge with traffic traveling along the second road surface 614. In addition, a left turn lane 616*b* is provided to permit traffic traveling along the third road surface 616 to commence a left-hand turn. The traffic in the left-hand turn lane 616*b* would travel beneath the third road surface 616 and the fourth road surface 618. Thereafter, the traffic would travel beneath the second road surface 614 and the first road surface 612. Finally, the traffic in the left turn lane 616*b* would merge with the traffic on the first road surface 612. Traffic traveling along the third road surface 616 can commence a U-turn by traveling along the U-turn section 616*c*. Thereafter, the traffic will merge with the traffic traveling along the fourth road surface 618.

Traffic traveling along the fourth road surface 618 can commence a right-hand turn by exiting onto the right-hand turn lane 618*a*. Thereafter, the traffic will merge with traffic traveling along the first road surface 612. In addition, a left-hand turn lane 618*b* travels beneath the fourth road surface 618 and the third road surface 616. Therefore, the left turn lane 618*b* travels beneath the first road surface 612 and the second road surface 614. Finally, the traffic will merge together with the traffic on the second road surface 614. Traffic traveling along the fourth road surface 618 may commence a U-turn by utilizing the U-turn section 618*c*. Thereafter the traffic traveling along the U-turn section 618*c* will merge with traffic traveling along the third road surface 616.

FIG. 14 is substantially similar to the road surface as illustrated in FIG. 13. Both FIGS. 13 and 14 illustrate left-hand turns which commence from the right lane of any of the road surfaces and permit motorists to travel onto an intersecting road surface on the right-hand side. The reference numerals in FIG. 14 are substantially similar to the reference numerals in FIG. 13. However, a traffic light 710 is provided to enable individuals traveling along a local road surface 614*c* to stop to permit traffic traveling along the left turn lane 612*b* to complete a left turn. Thereafter, traffic traveling along the road surface 614*c* will continue onto the road surface 614*d*. In this manner, traffic on the road surface 614*d* may frequent shops disposed in the northwestern quadrant of the schematic drawing.

Similarly, a traffic light 711 is provided to control the traffic traveling along a road surface 612*c*. Traffic in the left turn lane 614*b* can be controlled relative to the traffic in the local roadway 612*c*. Traffic traveling along the local roadway 612*c* can continue onto the roadway 612*d*. In this manner, traffic on the roadway 612*d* can frequent shops in the southeastern quadrant of the schematic drawing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A continuous flow intersection for accommodating traffic from a plurality of road surfaces comprising:

a first road for traffic traveling in a first direction;

a second road surface for traffic traveling in a direction opposite to said first direction;

a third road surface for traffic traveling in a direction intersecting said second then said first road surfaces;

a fourth road surface for traffic traveling in a direction opposite to said traffic traveling on said third road surface;

said first and second road surfaces intersecting said third and fourth road surfaces at a crossing area;

said first and second road surfaces being disposed at a first elevation distinct from the elevations of said third and fourth road surfaces;

a first road surface left turn lane being disposed along said first road surface at a distance prior to the crossing area in the direction of travel, said first road surface left turn lane diverting traffic from said first road surface and crossing said second road surface prior to the crossing area in the direction of travel and continuing traveling in a direction opposite to said second road surface in an area to the right of said second road surface traffic direction without diverting through traffic traveling along said first and second road surfaces;

said first road surface left turn lane traverses said third and fourth road surfaces at said first elevation distinct from the elevation of said third and fourth road surfaces and laterally from said second road surfaces, turns left and merges with said fourth road surface.

2. A continuous flow intersection according to claim 1, wherein said first road surface left turn lane initially directs traffic from a left side of the first road surface prior to crossing the second road surface.

3. A continuous flow intersection according to claim 1, wherein said first road surface left turn lane initially directs traffic from a right side of the first road surface.

4. A continuous flow intersection according to claim 1, wherein said first road surface left turn lane undercrosses said second road surface.

5. A continuous flow intersection according to claim 1, wherein said first and second road surfaces are disposed at a higher elevation relative to said third and fourth road surfaces and said first road surface left turn lane is elevated to the height of said first and second road surfaces prior to turning left in the general direction of said fourth road surface.

6. A continuous flow intersection according to claim 1, and further including a U-turn section disposed adjacent to said first road surface left turn lane for enabling traffic to change direction by directing the traffic unto said second road surface.

7. A continuous flow intersection according to claim 1, and further including:

a second road surface left turn lane being disposed along said second road surface at a distance prior to the crossing area in the direction of travel, said second road surface left turn lane diverting traffic from said second road surface and crossing said first road surface prior to the crossing area in the direction of travel and continuing traveling in a direction opposite to said first road surface in an area to the right of said first road surface traffic direction without diverting through traffic traveling along said first and second road surfaces;

said second road surface left turn lane traverses said third and fourth road surfaces at said first elevation distinct from the elevations of said third and fourth road surfaces and laterally from said first road surfaces, turns left and merges with said third road surface.

8. A continuous flow intersection according to claim 7, wherein said second road surface left turn lane initially directs traffic from a left side of the second road surface prior to crossing the first road surface.

9. A continuous flow intersection according to claim 7, wherein said second road surface left turn lane initially directs traffic from a right side of the second road surface.

10. A continuous flow intersection according to claim 7, wherein said second road surface left turn lane undercrosses said first road surface.

11. A continuous flow intersection according to claim 7, wherein said first and second road surfaces are disposed at a higher elevation relative to said third and fourth road surfaces and said second road surface left turn lane is elevated to the height of said first and second road surfaces prior to turning left in the general direction of said third road surface.

12. A continuous flow intersection according to claim 7, and further including a U-turn section disposed adjacent to said second road surface left turn lane for enabling traffic to change direction by directing the traffic unto said first road surface.

13. A continuous flow intersection according to claim 1, and further including;

a third road surface left turn lane being disposed along said third road surface at a distance prior to the crossing area in the direction of travel, said third road surface left turn lane diverting traffic from said third road surface and crossing said fourth road surface prior to the crossing area in the direction of travel and continuing traveling in a direction opposite to said fourth road surface in an area to the right of said fourth road surface traffic direction without diverting through traffic traveling along said third and fourth road surfaces;

said third road surface left turn lane traverses said first and second road surfaces at a second elevation distinct from the elevations of said first and second road surfaces and laterally from said fourth road surfaces, turns left and merges with said first road surface.

14. A continuous flow intersection according to claim 13, wherein said third road surface left turn lane initially directs traffic from a left side of the third road surface prior to crossing the fourth road surface.

15. A continuous flow intersection according to claim 13, wherein said third road surface left turn lane initially directs traffic from a right side of the third road surface.

16. A continuous flow intersection according to claim 13, wherein said third road surface left turn lane undercrosses said fourth road surface.

17. A continuous flow intersection according to claim 13, wherein said first and second road surfaces are disposed at a higher elevation relative to said third and fourth road surfaces and said third road surface left turn lane under-crosses said first and second road surfaces prior to turning left in the general direction of said first road surface.

18. A continuous flow intersection according to claim 13, and further including a U-turn section disposed adjacent to said third road surface left turn lane for enabling traffic to change direction by directing the traffic unto said fourth road surface prior to reaching the intersection.

19. A continuous flow intersection according to claim 1, and further including:

a fourth road surface left turn lane being disposed along said fourth road surface at a distance prior to the crossing area in the direction of travel, said fourth road surface left turn diverting traffic from said fourth road surface and crossing said third road surface prior to the crossing area in the direction of travel and continuing traveling in a direction opposite to said third road surface in an area to the right of said third road surface traffic direction without diverting through traffic traveling along said third and fourth road surfaces;

said fourth road surface left turn lane traverses said first and second road surfaces at a second elevation distinct from the elevations of said first and second road surfaces and laterally from said third road surfaces, turns left and merges with said second road surface.

20. A continuous flow intersection according to claim 19, wherein said fourth road surface left turn lane initially directs traffic from a left side of the fourth road surface prior to crossing the third road surface.

21. A continuous flow intersection according to claim 19, wherein said fourth road surface left turn lane initially directs traffic from a right side of the fourth road surface.

22. A continuous flow intersection according to claim 19, wherein said fourth road surface left turn lane under-crosses said third road surface.

23. A continuous flow intersection according to claim 19, wherein said first and second road surfaces are disposed at a higher elevation relative to said third and fourth road surfaces and said fourth road surface left turn lane under-crosses said first and second road surfaces prior to turning left in the general direction of said second road surface.

24. A continuous flow intersection according to claim 19, and further including a U-turn section disposed adjacent to said fourth road surface left turn lane for enabling traffic to change direction by directing the traffic unto said third road surface prior to reaching the intersection.

* * * * *